US006237432B1

(12) United States Patent
Vilou

(10) Patent No.: US 6,237,432 B1
(45) Date of Patent: May 29, 2001

(54) MOTOR VEHICLE STARTER INCORPORATING IMPROVED OVERRUNNING CLUTCH

(75) Inventor: Gérard Vilou, Tassin (FR)

(73) Assignee: Valeo Equipement Electriques Moteur, Creteil (FR)

( * ) Notice: Subject to any disclaimer, the term of this patent is extended or adjusted under 35 U.S.C. 154(b) by 0 days.

(21) Appl. No.: 09/215,006

(22) Filed: Dec. 17, 1998

(30) Foreign Application Priority Data

Dec. 17, 1997 (FR) ..... 97 16111

(51) Int. Cl.[7] ..... F02N 5/02
(52) U.S. Cl. ..... 74/7 C; 192/66.22
(58) Field of Search ..... 192/66.22, 42, 192/104 R; 74/7 C, 7 A; 290/48

(56) References Cited

U.S. PATENT DOCUMENTS

| | | | | |
|---|---|---|---|---|
| 2,921,473 | * | 1/1960 | Fellows | 74/7 C |
| 3,666,958 | | 5/1972 | Ruhle et al. . | |
| 3,905,245 | * | 9/1975 | Mortensen | 74/7 C |
| 4,260,903 | * | 4/1981 | Mazzorana | 290/48 |
| 4,261,452 | * | 4/1981 | Barrows | 74/7 C X |
| 4,330,713 | * | 5/1982 | Greenwood | 290/48 |
| 4,777,836 | * | 10/1988 | Giometti | 74/7 C X |
| 5,046,373 | * | 9/1991 | Zabrowski et al. | 74/7 C X |
| 5,050,441 | * | 9/1991 | Giometti | 74/7 C |
| 5,237,882 | * | 8/1993 | Giometti | 74/7 A |
| 5,241,871 | * | 9/1993 | McKnight, III et al. | 74/7 C |

FOREIGN PATENT DOCUMENTS 0 732 498 9/1996 (EP) .

* cited by examiner

*Primary Examiner*—Thomas R. Hannon
*Assistant Examiner*—Colby Hansen
(74) *Attorney, Agent, or Firm*—Morgan & Finnegan, LLP

(57) ABSTRACT

In a starter for a motor vehicle internal combustion engine the pinion is rotationally coupled to the drive bush by a device enabling rotation of the drive bush relative to the pinion when the rotation speed of the pinion is greater than that of the drive bush. The device has complementary front and rear friction surfaces respectively carried by the pinion and the drive bush. The pinion is mounted to be mobile axially relative to the drive bush to which it is coupled. The two friction surfaces are pressed elastically into contact with each with a predetermined force.

14 Claims, 2 Drawing Sheets

FIG.2
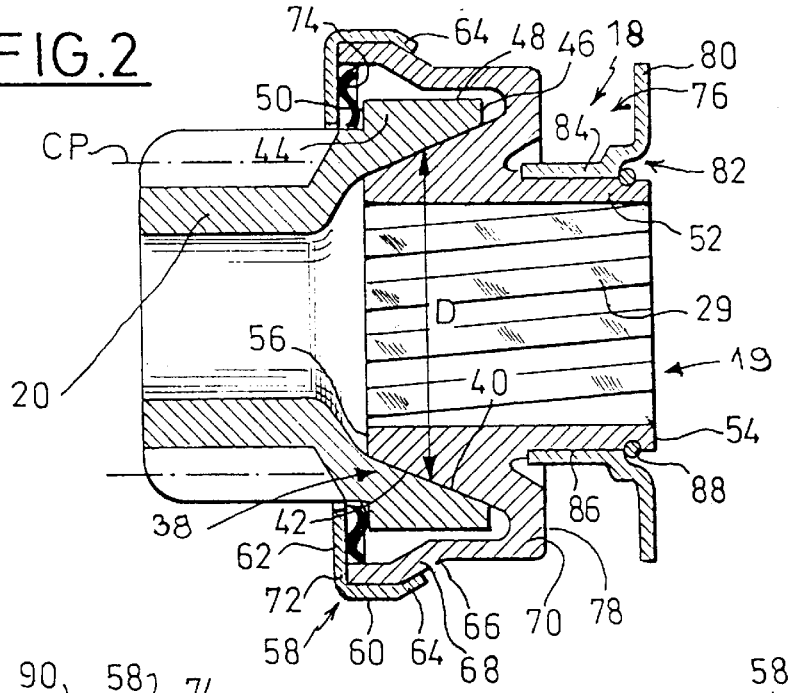
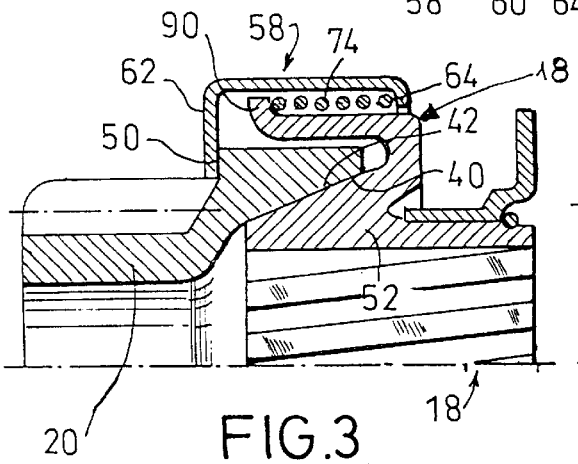
FIG.3
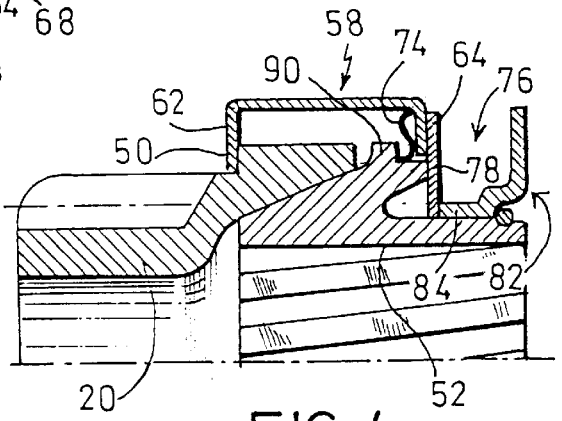
FIG.4
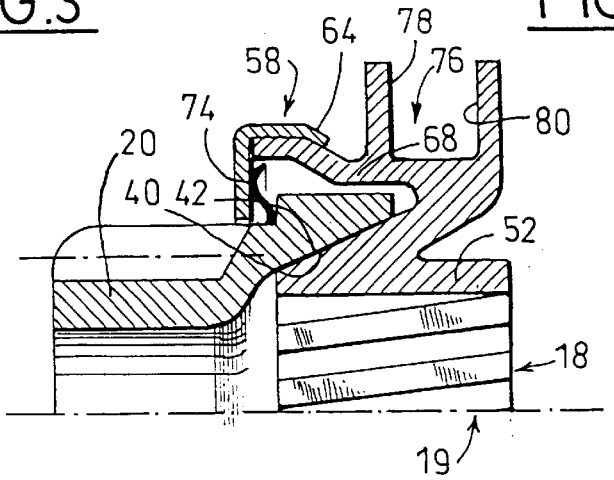
FIG.5

MOTOR VEHICLE STARTER INCORPORATING IMPROVED OVERRUNNING CLUTCH

FIELD OF THE INVENTION

The present invention concerns a starter for a motor vehicle combustion engine.

The invention is more particularly concerned with a starter of the type including an electric motor the drive shaft of which has helical splines for rotating a drive bush which is part of an overrunning clutch that can slide axially on the drive shaft between a rest position at the rear and a front position in which a pinion of the overrunning clutch meshes with a toothed ring on the flywheel of the internal combustion engine, and of the type in which the pinion is coupled axially to the drive bush with which it is constrained to rotate by a rotation enabling device of the drive bush relative to the pinion when the rotation speed of the pinion is greater than that of the drive bush.

BACKGROUND OF THE INVENTION

In conventional starters a freewheel device is disposed between the pinion and the drive bush. The main function of the freewheel is to prevent the pinion driving the electric motor of the starter at too high a speed, likely to damage it, when the internal combustion engine starts.

The freewheel device with rollers also damps sudden vibrations in the torque transmitted between the drive bush and the pinion.

This type of freewheel device using rollers offers very high performance, especially if the excessive speed of the pinion relative to the drive bush continues for a long period, which happens in particular if the driver does not de-energise the starter immediately after the internal combustion engine starts.

This phenomenon is occurring all the more frequently now that the passenger compartments of modern vehicles are increasingly better insulated from the acoustical point of view, this soundproofing blocking perception by the driver of the starting of the internal combustion engine, generally by listening for variations in the sound of the engine.

More recent electronically controlled starters include means for detecting starting of the internal combustion engine and for controlling the starter contactor in such a way as to return the overrunning clutch to its rest position by means of a lever on which the contactor acts.

Thus starters of the above kind use electronic control modules for their electric motor which automatically de-energise the electric motor of the starter and simultaneously return the drive bush to its rest position at the rear in which the pinion no longer meshes with the flywheel of the internal combustion engine.

The "freewheel" phase of operation is therefore of extremely short duration and is independent of the reaction time of the vehicle driver.

A prior art freewheel design, in particular of the type using rollers, is therefore overengineered for its purpose, in particular in relation to the short time for which it operates.

A freewheel of the above kind is therefore too bulky, too heavy and too costly for its function.

Completely eliminating the freewheel device has already been proposed, but eliminating the freewheel also eliminates the damping function, which is to the detriment of the mechanical durability of the starter and its operating noise level, which results in particular from the fact that the resisting torque imposed by the internal combustion engine varies greatly over one rotation of the crankshaft because of the cyclic forces compressing the gases present in the cylinders of the engine.

U.S. Pat. No. 3,666,958 to Ruhle et al. also proposes an inertial overrunning clutch design in which the coupling ring has a conical surround the section of which decreases in the direction towards the drive bush. During starting the enlarged conical drive bush acting on the elastic coupling ring engages with the conical surround. In the above device a compression spring bears against the pinion and against a stop ring fixed to the armature shaft.

In the above design the compression spring has a double role: to pre-stress the two cones and to return the overrunning clutch to its rest position and retain it there. Accordingly, in the operative position, the spring develops a maximal force that increases the residual torque during freewheel operation although a low force is required to avoid transmitting excessive overspeed to the armature.

DISCUSSION OF THE INVENTION

An aim of the invention is to overcome the drawbacks just mentioned by proposing a starter for a motor vehicle internal combustion engine of the type in which the pinion is rotationally coupled to the drive bush by a rotation enabling device of the drive bush relative to the pinion when its rotation speed is greater than that of the drive bush, wherein the device between the drive bush and the pinion includes complementary front and rear friction surfaces respectively carried by the pinion and the drive bush, the pinion is mounted to be mobile axially relative to the drive bush to which it is coupled and the two friction surfaces are pressed elastically into contact with each other with a predetermined force so that the drive bush can rotate relative to the pinion when the rotation speed of the overrunning clutch is greater than that of the drive bush.

In accordance with other features of the invention:

- the friction surfaces are two complementary frustoconical surfaces;
- the rear frustoconical friction surface is convex and extends axially towards the rear from the front end of the drive bush and in that the complementary front friction surface is concave and extends axially towards the front from the rear end of the drive pinion;
- the average diameter of the friction surfaces is substantially equal to the diameter of the primitive cylinder of the pinion;
- at least one of the two friction surfaces is covered with a friction lining;
- the rotation enabling device between the pinion and the drive bush includes radially oriented front and rear abutment surfaces respectively carried by the drive bush and the pinion and between which are mounted spring means compressed axially to urge the two friction surfaces into contact with each other;
- the front abutment surface or the rear abutment surface is an inside radial flange that is part of a connecting cap another inside radial flange of which is opposite an outside radial shoulder on the drive bush or on the pinion;
- the drive bush is moved axially from the rear towards the front by one end of a lever received axially in a radial groove in the drive bush.

Further features and advantages of the invention will appear more clearly on reading the following detailed description which is given with reference to the accompanying drawings.

BRIEF DESCRIPTION OF THE DRAWINGS

FIG. 2 is a view in axial section of a first embodiment of an overrunning clutch in accordance with the invention.

FIGS. 3 through 5 are views similar to that of FIG. 2 showing three variants of the FIG. 2 embodiment of the overrunning clutch.

DESCRIPTION OF PREFERRED EMBODIMENTS OF THE INVENTION

Figure 1:
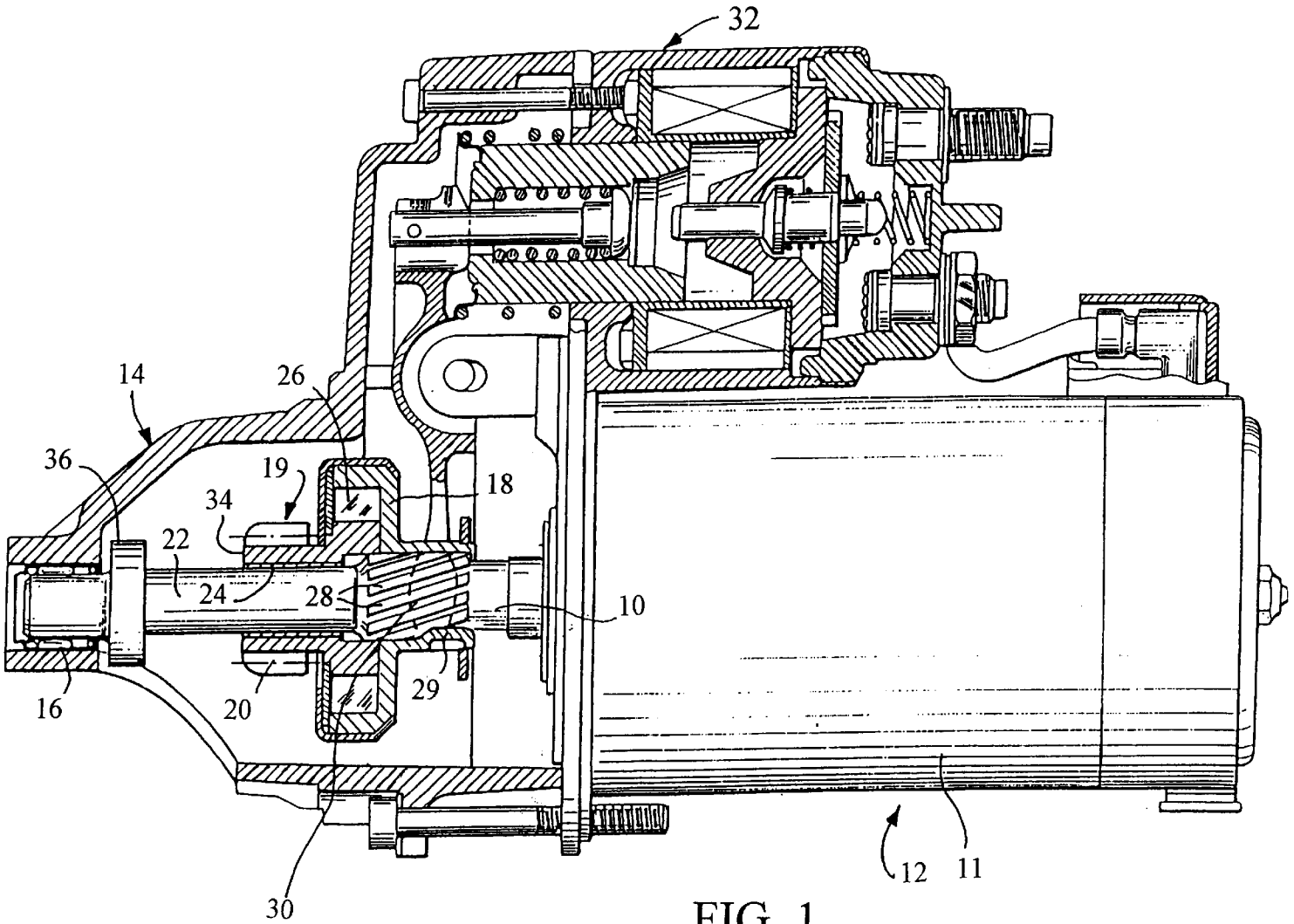
FIG. 1 PRIOR ART
FIG. 1 is a diagrammatic partial view in longitudinal section of a prior art motor vehicle starter in which the overrunning clutch includes a roller type freewheel device.

In the following description identical, similar or analogous components are designated by the same reference numbers in the various figures.

FIG. 1 shows a drive shaft 10 driven by an electric motor 11 of a starter 12 for a motor vehicle internal combustion engine.

The drive shaft 10 is rotatably mounted in a casing 14 by means of a needle roller bearing 16.

An overrunning clutch 19 slides axially on the front end of the shaft 10.

In a prior art design the overrunning clutch includes a drive bush 18 at the rear end in the axial direction, i.e. at the right-hand end as shown in FIG. 1, and a pinion 20.

The pinion 20 slides on a smooth cylindrical guide section 22 of the front end of the drive shaft 10 on a shell bearing 24.

The drive bush 18 is coupled axially to the pinion 20 by a roller type freewheel device 26 enabling the drive bush 18 to drive the pinion 20 in one rotation direction, called the drive direction of the shaft 10. In the opposite direction the freewheel device 26 disengages the pinion 20 from the drive shaft 10.

The drive bush 18 is itself driven in rotation by the drive shaft 10 by means of two series of helical splines 28, 29 respectively formed on the drive shaft 10 and in an internal cylindrical portion of the drive bush 18.

Sliding of the drive bush 18 and the pinion 20 on the drive shaft 10 are commanded by a pivoting fork 30 of the starter 12 which is in turn commanded by a contactor 32 of conventional design. These arrangements are known in themselves.

The overrunning clutch 19 consisting of the coupled pinion and the drive bush 18 can therefore slide axially between its rest position at the rear shown in FIG. 1 and an active position at the front in which the teeth of the pinion 20 mesh with a toothed ring (not shown) on the flywheel of the internal combustion engine, this position corresponding to axial displacement of the overrunning clutch 19, towards the left as seen in FIG. 1, until the front transverse face 34 of the pinion 20 abuts axially against a stop ring 36 carried by the shaft 10.

In accordance with the teachings of the invention it is proposed to eliminate the roller type freewheel 26 and to replace it with another device, a first embodiment of which is shown in FIG. 2.

In accordance with the teachings of the invention the drive bush 18 and the pinion 20 are rotationally coupled by a device 38 similar to a friction clutch 38 which has complementary front and rear friction faces 40 and 42.

The surface 40 is a concave frustoconical surface coaxial with the axis of the overrunning clutch 19 and therefore with the axis of the pinion 20 which carries the friction surface 40.

The toothed part of the pinion 20 is extended axially rearwards towards the drive bush 18 by a tubular section 44 in one piece with the body of the pinion 20 and which has the friction surface 40 on its interior (see FIG. 2).

Thus the pinion 20 is delimited axially towards the rear by a rear end annular transverse edge 46.

The rear tubular portion 44 is delimited in the radially outwards direction by a cylindrical surface 48 and towards the front by a front radial shoulder 50.

Embodying a design that is known in itself, the drive bush 18 includes a tubular body 52 within which are formed helical splines 29 and which is delimited by a rear annular transverse face 54 and a front annular transverse face 56.

The front part (on the left as shown in FIG. 2) of the tubular body 52 of the drive bush 18 is thicker than the rear part with the result that it is delimited in the radially outwards direction by the convex frustoconical friction surface 42 that extends axially rearwards from the front transverse end 56 approximately half the total axial length of the drive bush 18.

The frustoconical friction surfaces 40 and 42 are coaxial and complementary, i.e. they have the same cone angle.

The axial length of the two friction surfaces, corresponding to the distance between the rear end 46 of the pinion 20 and the front end 56 of the drive bush, and the cone angle of the frustoconical surfaces are such that the average diameter D of the frustoconical surfaces 40 and 42 is substantially equal to the diameter of the primitive cylinder CP of the pinion 20.

The pinion 20 is coupled axially to the drive bush 18 by a coupling cap 58 which is cut out and bent to shape from sheet metal, for example.

The cap 58 has an annular cylindrical external skirt 60 and a radially inwardly oriented front flange 62 which extends radially towards the body of the pinion 20 and the inside peripheral part of which lies axially opposite the front shoulder 50 that delimits the rear section 44 of the pinion 20.

The cap 58 also has a rear flange 64 which, during assembly of the overrunning clutch, is crimped radially inwards onto a frustoconical rear shoulder 66 formed on a cylinder 68 of the drive bush 18.

The cylinder 68 imparts a bell shape to the front portion of the drive bush 18 and extends axially towards the front. It is joined to the front section of the body 52 of the drive bush 18 by a radial rear wall 70. Its annular transverse edge at the front free end 72 provides a bearing surface for the portion of the inside face opposite the radial flange 62 of the crimped cap 58 that determines the axial position of the cap relative to the drive bush 18 after crimping.

In accordance with the teachings of the invention an axial action spring washer 74 is compressed axially between the front radial shoulder 50 of the pinion 20 and the opposite inside face of the inside radial flange 62 of the crimped cap 58 to press the frustoconical friction surfaces 40 and 42 elastically into contact with each other with a predetermined axial force F.

The rear axial part 52 of the drive bush 18 is conformed externally with a radial groove 76 of relatively great width in the axial direction which receives the free ends of the fork 30.

The groove 76 is delimited axially towards the front by the radially oriented rear transverse face 78 of the wall 50 and towards the rear by an external radial flange 80 which is part of a ring 82 attached to the thin tubular rear part of the body 52 of the drive bush 18.

To this end the ring 82 has a front tubular cylinder 84 threaded axially onto the rear cylindrical section 86 of the rear part of the tubular body 52, the ring 82 being retained axially to the drive bush 18 by a spring clip 88 received into a complementary groove on the surface 86.

The cylinder 84 of the ring 82 is preferably a force-fit on the rear part of the tubular body 52 of the drive bush 18.

If the drive bush 18 is made from a plastics material the cylinder 84 encircles the rear part of the tubular body 52 of the drive bush 18 to oppose radially outwards bursting forces resulting from reaction forces between the helical teeth 28 on the shaft 10 and the helical teeth 29 on the drive bush 18.

The spring, which here comprise the compressed spring washer 74, transmit an initial torque C from the drive bush 18 to the pinion 20 via the conical friction clutch 40, 42. The value of the torque C is equal to the product of the force F by a coefficient K which is a design feature and depends in particular on the average diameter D, on the coefficient of friction between the two surfaces 40 and 42 and on the cone angle of those surfaces.

During starting, when the electric motor of the starter begins to turn and the pinion 20, driven axially forwards by the drive bush 18, begins to penetrate axially into the starter ring on the flywheel of the engine, the initial torque C, which is very much lower than the torque needed for the starter ring to be driven by the starter, is sufficient to screw the overrunning clutch along the helical splines 28 on the shaft 10 to move the pinion 20 into abutment against the stop ring 36.

The overrunning clutch 19 can then no longer move axially forwards, i.e. to the left as shown in the figures, and the axial pressure force of the clutch 38, i.e. the axial force with which the frustoconical friction surfaces 40 and 42 are pressed together, increases with the resisting torque that the starter ring opposes to the motor by virtue of the "nut-and-bolt" system effect due to the co-operation of the helical splines 28 and 29 that convert the torque into an axial force.

A torque that can be transmitted by the clutch device 38 which is greater than the torque to be transmitted can be obtained by a choice of the various geometrical and manufacturing parameters, in particular the cone angle, the coefficient of friction of the surfaces 40 and 42 and the helix angle of the splines 28 and 29.

Under these conditions, the torque of the electric motor 11 of the starter is all transmitted to the pinion 20 to start the internal combustion engine.

When the internal combustion engine has started, the overrunning clutch 19 being retained axially with the pinion 20 co-operating with the starter ring through the intermediary of the contactor 32 for as long as the latter is energised, the pinion 20 turns faster than the output shaft 10, 22 of the electric motor 11 of the starter and the overrunning clutch 19 can be unscrewed along the shaft 10.

The axial force previously produced by the transmitted torque disappears and there remains only the initial residual torque C (due to the spring means 74) and this is transmitted to the electric motor of the starter. The residual initial torque C has a low value and in particular a value that is insufficient for any overspeed of the rotating parts of the electric motor to be communicated to the shaft 10.

This overspeed phase of operation, during which the friction clutch 38 behaves virtually as a freewheel device, is of course possible only if, allowing for the coefficient of friction between the surfaces 40 and 42, the cone angle is large enough to prevent axial wedging by virtue of a cone effect between the surfaces 40 and 42, i.e. if there is always a possibility of slight relative axial movement between the pinion 20 and the drive bush 18, i.e. between the friction surfaces 40 and 42.

The embodiment shown in FIG. 3 will now be described. In this figure the spring comprises a compression coil spring 74 disposed axially between a rear abutment surface which here is the rear internal radial flange 64 of the cap 58 and a front abutment surface which here is an opposite face of an outside radial rim 90 of the tubular part 68 of the body 52 of the drive bush 18.

In the embodiment shown in FIG. 4 the spring comprises a spring washer 74 disposed axially between a rear abutment surface consisting of the rear inside radial flange of the cap 58 and a front abutment surface consisting of the opposite annular face of an outside radial rim 90 of the front part of the body 52 of the drive bush 18.

The front face 78 of the groove 76 is provided by a washer 78 that is held in axial abutment towards the front by the cylinder 84 of the ring 82.

Finally, the variant shown in FIG. 5 differs from the FIG. 2 embodiment in terms of the constitution of the groove 76, the front face 78 and rear face 80 of which are provided by two radially oriented flanges in one piece with the body 52 of the drive bush 18.

In further variants that are not shown in the figures the coupling cap 58 can be fixed to the drive bush by any means, for example by elastic interengagement, welding, gluing, etc.

The spring washer 74 or the compression coil spring from FIG. 3 can be replaced by any other equivalent spring member such as a ring, an elastomer material block, etc.

The frustoconical friction surfaces 40 and 42 can be interchanged, i.e. the convex frustoconical surface can be associated with the pinion and the concave frustoconical surface formed in the drive bush 18.

Finally, to obtain the required coefficient of friction between the friction surfaces 40 and 42 and/or to improve the resistance to wear of the friction clutch 18 it is of course possible to cover either or both of the two surfaces 40 and 42 with a friction material lining.

What is claimed is:

1. A starter for a motor vehicle internal combustion engine comprising:

an electric motor, said electric motor having a drive shaft, said drive shaft having helical splines;

an overrunning clutch that can slide axially on said drive shaft between a rest position at the rear and an engagement position at the front, wherein said overrunning clutch comprises:

a drive bush, said drive bush capable of being driven in rotation by said helical splines of said drive shaft;

a pinion, wherein said pinion is coupled axially to said drive bush; and a rotation enabling device which constrains said pinion and said drive bush to rotate together, said rotation enabling device arranged to allow rotation of said drive bush relative to said pinion when said pinion's rotation speed is greater than that of said drive bush, wherein said rotation enabling device comprises:

front and rear friction surfaces, said friction surfaces being two complementary frustoconical surfaces respectively carried by said pinion and said drive bush, said pinion is mounted to be axially mobile relative to said drive bush to which said pinion is coupled, and said friction surfaces are pressed elastically into contact with each other, radially oriented front and rear abutment surfaces respectively carried by said drive bush and said pinion, and a spring mounted between said front and rear abutment surfaces, said spring being compressed axially to press said front and rear friction surfaces into contact with each other with a predetermined force.

2. A starter according to claim 1, wherein said rear frustoconical friction surface is convex and extends axially towards the rear from a front end of said drive bush, and said complementary front friction surface is concave and extends axially towards the front from a rear end of said drive pinion.

3. A starter according to claim 1, wherein said friction surfaces have an average diameter that is substantially equal to a diameter of primitive cylinder of said pinion.

4. A starter according to claim 1, wherein at least one of said two friction surfaces is covered with a friction lining.

5. A starter according to claim 1, wherein said front abutment surface or said rear abutment surface is an inside radial flange that is part of a connecting cap having another inside radial flange which is opposite an outside radial shoulder on said drive bush or on said pinion.

6. A starter according to claim 1, wherein said drive bush is moved axially from the rear towards the front by one end of a lever, said lever being received axially in a radial groove in said drive bush.

7. An automobile engine comprising said starter of claim 1.

8. A starter for a motor vehicle internal combustion engine comprising:

an electric motor, said electric motor having a drive shaft;

an overrunning clutch slidably mounted on said drive shaft, wherein said overrunning clutch comprises:

a drive bush, said drive bush capable of being rotationally driven by said said drive shaft;

a pinion, said pinion being coupled axially to said drive bush; and means for constraining said pinion and said drive bush to rotate together, said constraining means arranged to allow rotation of said drive bush relative to said pinion when said pinion's rotation speed is greater than that of said drive bush.

9. An overrunning clutch comprising:

a drive pinion;

a drive bush; and a rotation enabling device arranged to constrain said drive pinion and said drive bush to rotate together, said rotation enabling device being slidably mounted on a drive shaft, wherein said rotation enabling device is arranged to allow rotation of said drive bush relative to said drive pinion, said rotation enabling device comprising:

front and rear friction surfaces, said friction surfaces being two complementary frustoconical surfaces respectively carried by said drive pinion and said drive bush, wherein said friction surfaces are pressed elastically into contact with each other, radially oriented front and rear abutment surfaces respectively carried by said drive bush and said drive pinion, and a spring mounted between said front and rear abutment surfaces, said spring being compressed axially to press said front and rear friction surfaces into contact with each other with a predetermined force.

10. An overrunning clutch according to claim 9, wherein said rear frustoconical friction surface is convex and extends axially towards the rear from a front end of said drive bush and said complementary front friction surface is concave and extends axially towards the front from a rear end of said drive pinion.

11. An overrunning clutch according to claim 9, wherein said friction surfaces have an average diameter that is substantially equal to a diameter of a primitive cylinder of said drive pinion.

12. An overrunning clutch according to claim 9, wherein at least one of said two friction surfaces is covered with a friction lining.

13. An overrunning clutch according to claim 9, wherein said front abutment surface or said rear abutment surface is an inside radial flange that is part of a connecting cap having another inside radial flange which is opposite an outside radial shoulder on said drive bush or on said drive pinion.

14. An overrunning clutch according to claim 9, wherein said drive bush is moved axially from the rear towards the front by one end of a lever, said lever being received axially in a radial groove in said drive bush.

* * * * *